US006918812B2

(12) United States Patent
Giese

(10) Patent No.: US 6,918,812 B2
(45) Date of Patent: Jul. 19, 2005

(54) BRASSIERE FOR IMPROVED BREAST SUPPORT AND ENHANCEMENT

(76) Inventor: Sharon Giese, 12 E. 69th St., New York, NY (US) 10021

( * ) Notice: Subject to any disclaimer, the term of this patent is extended or adjusted under 35 U.S.C. 154(b) by 0 days.

(21) Appl. No.: 10/683,134

(22) Filed: Oct. 9, 2003

(65) Prior Publication Data

US 2005/0079794 A1 Apr. 14, 2005

(51) Int. Cl.[7] ..... A41C 3/00
(52) U.S. Cl. ..... 450/65; 450/66; 450/75
(58) Field of Search ..... 450/66, 67, 65, 450/74, 76, 92, 69, 70, 72, 73, 75; 2/67, 73, 78.1–78.3, 69; 66/171, 176, 177, 172 E, 153, 170

(56) References Cited

U.S. PATENT DOCUMENTS 3,595,243 A 7/1971 Mount
3,957,057 A * 5/1976 Farino ..... 450/54
4,413,625 A 11/1983 Footer
4,453,549 A * 6/1984 DiTullio ..... 450/74
5,045,019 A * 9/1991 Capasso et al. ..... 450/74
5,098,330 A 3/1992 Greenberg
5,167,566 A * 12/1992 Novitsky et al. ..... 450/74
5,171,182 A * 12/1992 Heinen ..... 450/74
5,823,851 A * 10/1998 Dicker ..... 450/2
5,868,601 A 2/1999 Kelemencky
6,165,047 A 12/2000 Scott et al.
6,213,842 B1 4/2001 Degirmenci
6,287,168 B1 * 9/2001 Rabinowicz ..... 450/75
6,685,534 B2 * 2/2004 Mitchell et al. ..... 450/74
6,685,535 B2 * 2/2004 Mitchell ..... 450/75

* cited by examiner

*Primary Examiner*—Gloria M. Hale
(74) *Attorney, Agent, or Firm*—Anderson Kill & Olick, PC

(57) ABSTRACT

A brassiere comprising two brassiere cups each having three separate panel sections representing a lateral panel section, a medial panel section and a superior panel section respectively with the three panel sections of each breast cup arranged such that the superior panel section extends superiorly to cover the nipple area of the breast and possesses a substantially greater elasticity than is possessed by the lateral and medial panel sections respectively.

15 Claims, 3 Drawing Sheets

FIG. 1
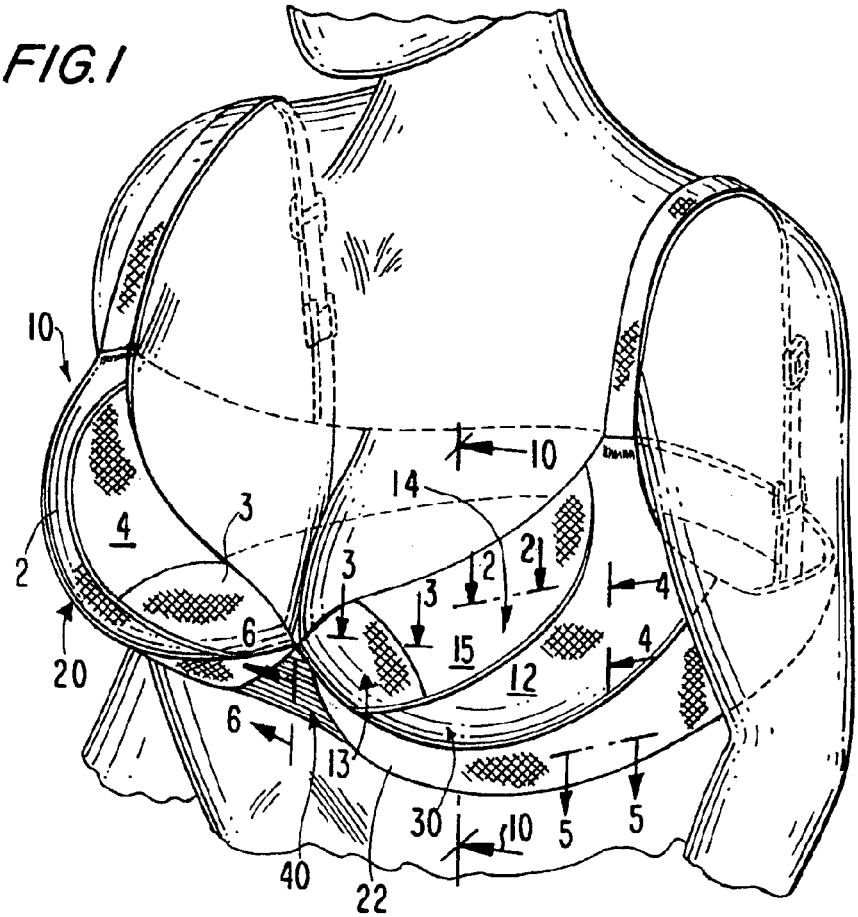
FIG. 2
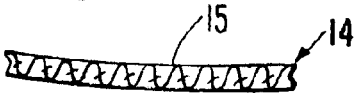
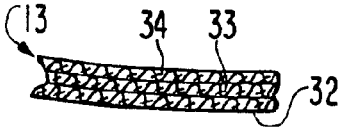
FIG. 3
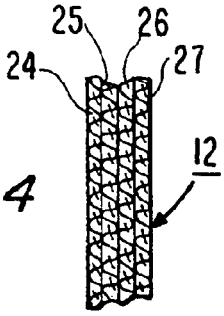
FIG. 4
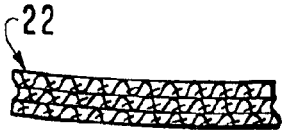
FIG. 5
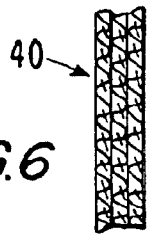
FIG. 6

70
71
72
73
66
74
65
60
9
8
B
38
22
12
30
14
13
A
A'
3
40
22a
20
4
2
39
60a
56

BRASSIERE FOR IMPROVED BREAST SUPPORT AND ENHANCEMENT

FIELD OF THE INVENTION

This invention relates generally to a brassiere for providing breast support, enhancement and cleavage control and more particularly to the construction of a brassiere which applies force in a medial direction for directing the breasts toward one another and in a superior direction relative to the chest wall for lifting the breasts upwardly.

BACKGROUND OF THE INVENTION

Many attempts have been made in the past to construct a brassiere which will provide improved breast support and enhancement as is taught in the following patent disclosures:

U.S. Pat. No. 5,868,601, for example, teaches the use of externally placed support straps to pull the breast together so as to unnaturally create an enhanced cleavage line.

U.S. Pat. No. 5,098,330 employs elastomeric members to create compressive forces intended for use with added padding to push the breasts upwardly and inwardly toward each other. The arrangement is ackward and unwieldy as well as cosmetically unattractive.

U.S. Pat. No. 6,165,047 teaches a brassiere within a brassiere construction for use in combination with excessive padding to volumetrically enhance the breast. The inner cup is placed firmly against the breast, forcing the natural breast tissue away from the middle of the chest which is directly opposite to the desired force direction to create cleavage.

U.S. Pat. No. 6,213,842 incorporates a stretchable band in each breast cup to control the forces on the breasts when tension is naturally applied to the band and a force to move the breasts laterally toward one another. However, the use of stretchable bands actually limits the lateral excursion of the breast when tension is naturally applied around the chest and, as such, limits the degree of breast enhancement.

U.S. Pat. No. 3,595,243 contemplates adding pull elements to provide elevation of the breast and U.S. Pat. No. 4,413,625 teaches shortening the side panels of the brassiere to cause breast elevation.

Other known techniques involve different measuring systems to measure bra sizes so as to permit the design of the bra to accommodate differences in volumetric breast size as well as differences in the perimeter of the breast on the chest.

All of the above prior art brassiere designs contemplate the use of extra padding as an integral part of the design which is unwieldy from a manufacturing standpoint and none teach using an anthropometrical standard applicable to most women.

Accordingly it is an object of the present invention to provide a brassiere design which will cause breast enhancement, cleavage and support while maximizing the natural breast volume without any reliance on extra padding.

Another object of the present invention is to present an anthropometric standard which, will be utilized to create breast cleavage for average to slightly above average weight women using a brassiere construction that satisfies the finding that the base width of the average woman's breast changes minimally over varying chest circumferences and cup sizes. Adhering to this correlation is critical to the creation of cleavage in the said group of women.

Still another object of the present invention is to provide a brassiere construction which will control breast cleavage using a design common to two breast cups with each cup formed of three panel sections designed with varying elasticity and different yield points so as to aid and reenforce the superior-medial force required to create cleavage.

Yet another object of the present invention is to provide an improved brassiere construction that can be economically manufactured for use an independent brassiere or incorporated into many different garments, such as swimsuits and evening gowns for sale as one garment.

SUMMARY OF THE INVENTION

It is believed that a large percentage of women are accommodated with ill-fitted brassieres due to the lack of a reliable industry standard for correlating brassiere size with women's anatomy. It has been discovered in accordance with the present invention that an anthropometric standard does indeed exist to correlate brassiere size with the average women's anatomy which will enable a single brassiere design to satisfy all normal to slightly overweight women (limited to women who are not obese) having average to above average sized breasts.

The brassiere of the present invention is designed to support and exert force on the wearer's breasts to move them to a more superior and medial direction on the chest wall in accordance with an anthropometric standard. This anthropometric standard is achieved in accordance with the present invention by designing the brassiere to satisfy a narrow breast base width measurement for each breast cup when the brassiere is extended; i.e., when worn. The base width standard may be accomplished by controlling the elasticity of the panel sections of the brassiere relative to one another such that the base width of each breast cup stays within a narrow measurement of preferably between 10.5 and 14.5 cm, and more preferably between 11.5 to 13.5 centimeters. Previously the base width of a brassiere breast cup when extended around the chest, significantly exceeded this measurment. A brassiere which meets this standard will accommodate normal to slightly overweight women with average to somewhat above average breasts without the need for excess padding. Heretofore a brassiere was never designed to satisfy a limited base width measurement for each breast cup.

From an overall perspective the brassiere of the present invention broadly comprises two brassiere cups each having three separate panel sections representing a lateral panel section, a medial panel section and a superior panel section respectively with the three panel sections of each breast cup arranged such that the superior panel section extends superiorly to cover the nipple area of the breast and with the elasticity of the panel sections of the brassiere relative to one another controlled such that the superior panel section possesses a substantially greater elasticity than is possessed by the other two panel sections and with the base width measurement of each breast cup limited to a narrow measurement of preferably between 10.5 and 14.5 cm, and more preferably between 11.5 to 13.5 centimeters.

BRIEF DESCRIPTION OF THE OF THE DRAWINGS

Other advantages of the present invention will become apparent from the following description of the invention when read in conjunction with the accompanying drawings of which:

FIG. 1 is a front perspective of a brassiere according to the present invention;

FIG. 2 is a sectional view taken along the lines 2—2 of FIG. 1;

FIG. 3 is a sectional view taken along the lines 3—3 of FIG. 1;

FIG. 4 is a sectional view taken along the lines 4—4 of FIG. 1;

FIG. 5 is a sectional view taken along the lines 5—5 of FIG. 1;

FIG. 6 is a sectional view taken along the lines 6—6 of FIG. 1;

DETAILED DESCRIPTION OF THE PREFERRED EMBODIMENTS

Figures 7, 8, 9:
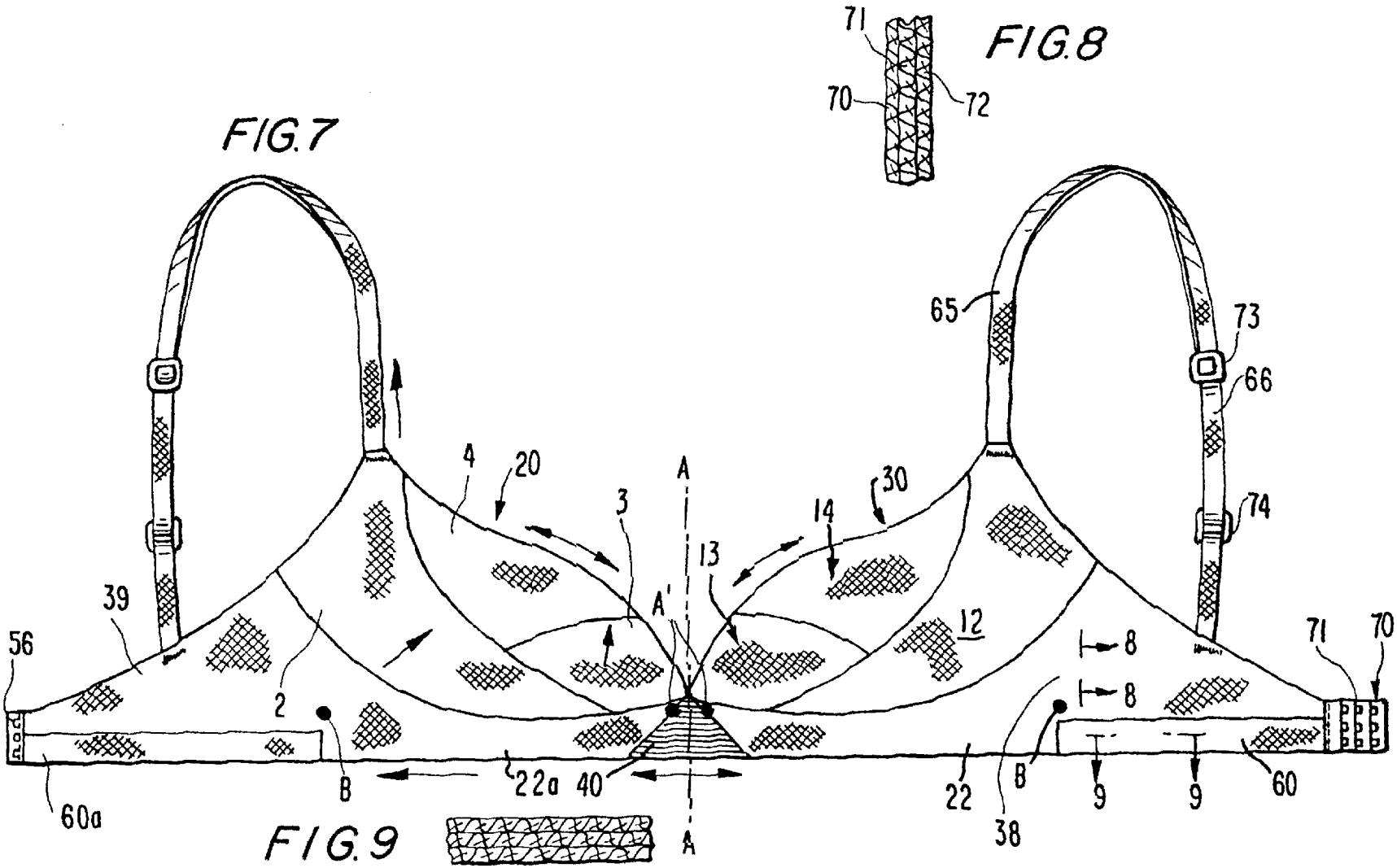
FIG. 7 is a front elevation of the brassier of FIG. 1.
FIG. 8 is a sectional view taken along the lines 8—8 of FIG. 7.
FIG. 9 is a sectional view taken along the lines 9—9 of FIG. 7.

Reference is made to FIGS. 1–9 inclusive. In FIG. 1 the brassiere 10 of the present invention is shown, for purpose of illustration, secured in place on the torso of a women's body. The brassiere 10 includes a first breast cup 20 and a corresponding second breast cup 30 interconnected at the medial as is shown in FIGS. 1 and 7. Anterior support members 22 and 22*a*, also referred to as chest bands, are located beneath each breast cup 20 and 30. A central connector 40 may be used to interconnect the first and second breast cups at the medial in which case the central connector 40 is continguous to the support members 22 and 22*a*. Alternatively, the central connector 40 may be integrated into the anterior support members thereby forming a single continuous anterior support member for both breast cups 20 and 30.

Each breast cup 20 and 30 has three separate panel sections which, in combination, support the breast when worn by a user. The three panel sections of the breast cup 20 are defined to represent a lateral panel section 2, a medial panel section 3 and a superior panel section 4 respectively. Likewise, the breast cup 30 includes a corresponding lateral panel section 12, a medial panel section 13 and a superior panel section 14. Since the breast cup 20 and the breast cup 30 are of identical construction, only one breast cup, namely breast cup 30, will hereafter be further described in detail relative to the drawings with the understanding that the other breast cup 20 is constructed with a corresponding number of layers in the same arrangement and of the same materials. As will become more apparent hereafter the material(s) of constuction for each of the three panel sections of each of the breast cups 20 and 30 play a significant role in the present invention relative to one another, to the central connector 40 and chest bands 22 and 22*a* and the other members of the brassiere 10. Any natural or synthetic fabric material may be used in the construction of the different panels to satify the elasticity requirements of the panels in accordance with the present invention.

The description of the materials of construction for each of the three panel sections 12, 13 and 14 of the breast cup 30 will now be explained with reference to FIGS. 1 through 9 inclusive. FIGS. 2 through 6 are sectional views indicative of a preferred arrangement for the number of fabric layers selected for each of the three panel sections 12, 13 and 14 of the breast cup 30.

The superior panel section 14 aids in the containment of the breast tissue and is constructed to possess a substantially greater elasticity, i.e., capacity to strech based upon having an Instrom value of not more than about 20# (±10%) relative to the elasticity (stretch) possessed by either of the other two panel sections 12 and 13 of breast cup 30. The difference in elasticity is primarily established using different materials of construction (composition) and secondarily by the selection of the material yield point. Moreover, the superior panel section 14 need only be composed of one layer 15 as is shown in FIG. 2 which is preferably smooth in its characteristic and possessing a greater elongation in terms of its Instrom value relative to the Instrom values of the other panel sections 12 and 13 respectively. The layer 15 must provide enough force in a lateral mesial direction as shown by the double headed arrow in FIG. 7 to contain the breast tissue from being forced out of the brassiere. The superior panel 14 should also extend superiorly to cover the nipple areola complex of the breast. An outer layer of fabric (not shown) may be used as a covering and can represent a layer in common with one or both of the outer covering layers of the panel sections 12 and 13 respectively.

The lateral panel section 12 is secured preferably by stiching to the superior panel section 14 and to the medial panel section 13. The lateral panel section 12 is shaped to follow the inframammary fold, lower curvature of the breast, and is secured to an anterior support member 22 of the brassiere 10. The lateral panel section 12 is also secured to a side panel 38 of the brassiere 10 at its lateral extent which extends superiorly and laterally toward the anterior breast strap 65 to which the lateral panel section 12 is also secured by stitching. The lateral panel section 12 is composed of multiple superimposed layers of material, preferably four layers as shown in FIG. 4, with the layers arranged in tandum. The innermost layer 24 represents an inner thin lining which will contact breast tissue and should possess a moisture-wicking (absorbant) characteristic to provide comfort to the wearer. The next adjacent layer 25 is constructed of a fabric which has the highest modulus and least elongation with an Instrom value of 25# or greater resulting in the panel section 12 having the least stretch as compared to panels 13 and 14 when tension is naturally applied around the chest in a direction at an inclined angle to the horizontal between the superior and medial directions as indicated by the arrow in FIG. 7. The next adjacent layer 26 may be stitched to provide an optional flap opening to add volume to the breast if desired. The fourth layer 27 defines an outer covering for the lateral panel section 12 which may be contiguous to the outer covering of the medial panel section 13 or form a single outer covering in common with the outer covering of the medial panel section 13 and may also be contiguous with the superior panel section 14 to aesthetically create a smooth outer appearance for support which may further be garnished with any sort of decorative fabrication such as lace. The lateral panel sections of each breast cup 20 and 30 are minimally distensible and function to force the naturally, laterally falling breast tissue to a more superior and medial position when the brassiere is secured around the chest wall after appropriately adjusting the breast straps 65 and 66 respectively.

The medial panel section 13 is secured to an anterior support member 22 of the brassiere 10 and is shaped to continue to follow the lower curvature of the breast where it is attached to the central connector 40 bringing the two breast cups 20 and 30 to one another. The medial panel section 13 is also secured, preferably by stitching, to the lateral panel section 12 and to the superior panel section 14.

The medial panel section 13, as shown in FIG. 3, is composed of preferably three superimposed layers of material with the innermost layer 32 representing an inner thin lining similar in construction to the inner lining 24 and having the same purpose. In fact it may be fabricated to be continuous or contiguous to the inner lining 24 of the medial panel section 13 to provide comfort to the wearer. The next adjacent layer 33 should provide panel section 13 with a stretch capability which is moderate i.e, intermediate the stretch capability of panels 12 and 14 having a preferred Instrom value of about 22# or greater, i.e. between 20# and 25#, with its stretch sufficient to create a force extending in a direction superiorly as indicated by the arrow in FIG. 7. The outer layer 34 defines an outer covering for the medial panel section 13 equivalent to the outer covering 27 of the medial panel section 13 and may be fabricated as a single outer covering for both panels or may be contiguous to the outer covering 27 of the medial panel section 13 and to the outer covering of the superior panel section 14 if one is provided to aesthetically create a smooth outer appearance for support which may further be garnished with any sort of decorative fabrication such as lace. The medial panel sections of the breast cups are only slightly more distensible than the lateral panel sections to reinforce the superior thrust of the breast tissue which otherwise naturally falls inferiorly.

The above described cup panels 12, 13, and 14 with their own unique elastic properties, for creating differing forces on the breast mound, when the brassiere 10 is secured about the chest wall (extended) can also be achieved by a single manufactured piece of fabric. The fabric would have the same above described differences in strength but are created internally in the fabric by e.g., modifying the denier of each of the selected panels for effectively controlling the elasticity. The same unique differences in elasticity and strength can be created in a single piece of woven fabric to create the same forces on the breast mound in each breast cup.

The central connector 40 bridging the two breast cups 20 and 30 and the anterior support members 22 and 22*a* are each composed of at least two superimposed layers of material as shown in FIGS. 5 and 6 respectively with at least one layer designed to add structural integrity to the brasserier 10 by anchoring the breast cups 20 and 30 down. The central connector 40 should be minimally distensible, i.e., provide little elasticity so as to form a counter force to the force developed by the anterior support members 22 and 22*a* and the posterior support member 60 extending from the anterior support member 22 around the back of the wearer. Connector 40 may also be incorporated into the anterior support members 22 and 22*a*; thereby resulting in one continguous anterior member support achieveing the same goals.

The anterior support member 22 has a superior border secured to the lateral panel section 12 and to the medial panel section 13 of the breast cup 30 and is likewise coincident with and secured to the lower edges of the lateral panel section 2 and to the medial panel section 3 respectively in breast cup 20. Accordingly the superior border of the anterior support member 22 conforms in shape to the inframammary fold, lower curvature of the breast. The anterior support member 22 also extends rearwardly or is secured to the posterior support member 60 extending around the back of the wearer. The anterior support member 22 is preferably composed of at least two layers of superimposed fabric material, as is shown in FIG. 5, each of which should be moderately distensible, i.e., provide a moderate degree of elasticity to anchor the brassiere 10 to the anterior chest wall and to mainly provide lateral tension force as shown by the arrow in FIG. 7 and to a lesser extent provide an inferior directed downward tension force to counter the superior tension pull forces from the brassiere straps 65 and 66.

Each of the posterior support members 60, 60*a* for each breast cup 30 and 20 are joined together in the mid region of the back in any conventional fashion using, for example, a hook mechanism 55 and clips 56. The posterior support member 60 is preferably composed of at least two layers of superimposed material as is shown in FIG. 9 with one or two layers possessing moderate distensibility to anchor the brassiere 10 around the chest and an optional outer layers functioning in the same capacity as the outer layers of the lateral panel section 12 and medial panel section 13 respectively. The anterior and posterior support members anchors the brassiere to the chest and counterbalance the superior pull of the breast straps. The anterior and posterior support members have structural integrity derived from material fabrication and yield point and do not necessitate the use of a wire. When the support member is secured posteriorly the central connector functions to set the width of the breast cups against the lateral tension of the support members. The central connector 40 also functions as a central, inferior and anchoring force, but can alternatively be incorporated in the anterior support member 22.

Reference is made again particularly to FIG. 7 showing the side panels 38, 39 which span and reinforce connection anteriorly between the side panels 38, 39 and the breast cups 20 and 30 and posteriorly the connection between the side panels 38, 39 and the posterior straps 66 and 67. The side panel 38 as is shown in FIG. 8 has at least two layers, composed of an optional inner layer 70, which is a thin distensible moisture-wicking fabric for comfort, a mid-section layer 71, which is moderately distensible for support, and at least an outer covering 72. The side panel 38 attaches high to the breast cup 30 extending above the height of the central connector 40 to contain and support any axillary fat, helping to create a smooth appearance to the axillary roll.

The anterior brassiere straps 65 and the posterior brassiere straps 66 employ adjustable loops 73 and 74 for manual adjustment of each strap on the shoulders of the wearer. The anterior strap 65 establishes a superior force vector as shown in FIG. 7.

Figure 10:
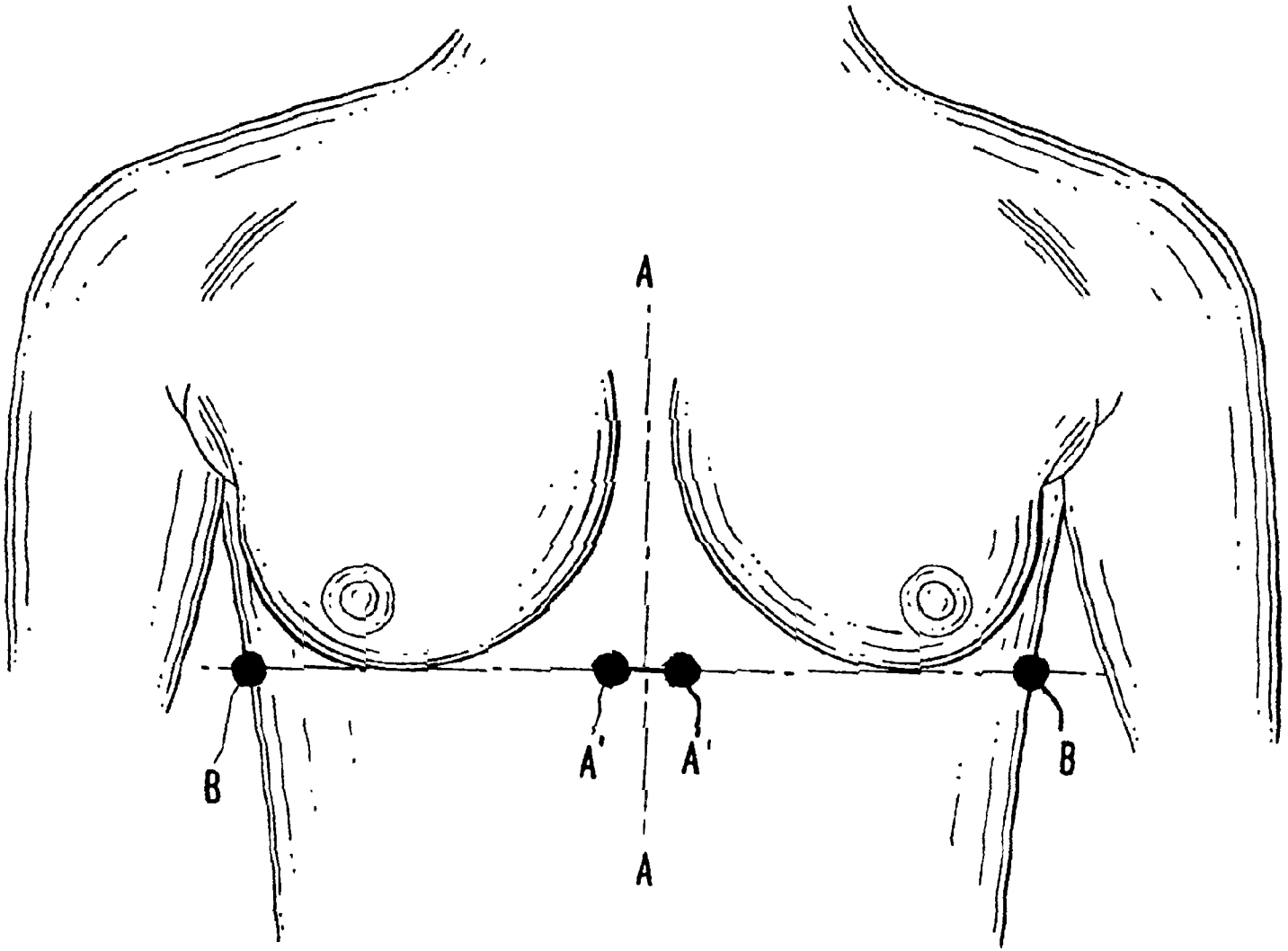
FIG. 10 is a perspective anatomical view of the female breasts indicating the lateral and medial positions.

As explained hereinbefore, by designing the brassiere so that the base width measurement of each breast cup when extended stays within a fixed linear measurement of between 10.5 and 14.5 cm, preferably, 11.5 to 13.5 centimeters the anthropometric standard will be achieved. The measurement is a linear one preferably taken as shown in FIG. 10 between points A' and B for each breast cup. The position A corresponds to a point along the midline of the chest, A' corresponds to the medial extent of the breast, and point B corresponds to lateral extent of each breast anatomically, as is known to those skilled in the medical profession. The measurements between points A, A' and B can readily be measured on a brassiere in the extended position and they should correspond to those measurements on the body as seen in FIG. 10.

What is claimed is:

1. A brassiere comprising two brassiere cups each having three separate panel sections representing a lateral panel section, a medial panel section and a superior panel section respectively with the three panel sections of each breast cup arranged such that the lateral panel section acts as a sling and possesses substantially less elasticity than is possessed by the superior and medial panel sections respectively such that the brassiere satisfies a narrow base width measurement for each breast cup of between 10.5 and 14.5 centimeters when the brassiere is extended.

2. A brassiere as defined in claim 1 wherein the base width measurement for each breast cup is between 11.5 and 13.5 cm.

3. A brassiere as defined in claim 1 further comprising an anterior support member for each breast cup with each anterior support member connected to the lateral panel section and medial panel section of each corresponding breast cup respectively.

4. A brassiere as defined in claim 3 wherein the anterior support member bridges the two breast cups together at the junction with each medial panel section through a central connector.

5. A brassiere as defined in claim 1 wherein said superior panel section of each breast cup has an elasticity with an Instrom value of not more than about 20# (±10%) relative to the elasticity (stretch) possessed by either of the other two panel sections in each breast cup respectively.

6. A brassiere as defined in claim 5 wherein said lateral panel section of each breast cup has an elasticity with an Instrom value of 25# or greater.

7. A brassiere as defined in claim 6 wherein said medial panel section of each breast cup has an elasticity with an Instrom value of 22# or greater resulting in the medial panel section having a stretch between the lateral and superior panel sections when tension is naturally applied around the chest in a superior direction.

8. A brassiere as defined in claim 7 wherein said superior, medial and lateral panel sections are woven from a single piece of fabric.

9. A brassiere as defined in claim 7 wherein each lateral panel section of each breast cup has a lower edge shaped to follow the inframammary fold lower curvature of the breast.

10. A brassiere as defined in claim 3 further comprising a side panel and an anterior breast strap for each breast cup with each side panel connected to a corresponding lateral panel section of each breast cup respectively and extending superiorly and laterally toward the anterior breast strap to which the lateral panel section is also secured.

11. A brassiere as defined in claim 10 wherein the side panels attach to the lateral sections of the breast cups above the central connector.

12. A brassiere as defined in claim 6 wherein each lateral panel section is composed of one or more layers.

13. A brassiere as defined in claim 12 wherein each lateral panel section is comprised of four layers having an innermost layer functioning as an inner thin lining adapted to contact breast tissue and a layer which will be minimally distensible relative to the elasticity of the superior panel section for forming a fore when tension is naturally applied around the chest in a direction at an inclined angle to the horizontal between the superior and medial directions.

14. A brassiere as defined in claim 6 wherein each medial panel section is composed of a plurality of superimposed layers.

15. A brassiere as defined in claim 14 wherein each medial panel section is composed of three layers having an innermost layer functioning as an inner thin lining adapted to contact breast tissue and a layer which will be possess moderate elasticity relative to the elasticity of the lateral panel section.

* * * * *